United States Patent [19]

Jacavanco

[11] Patent Number: 4,631,547

[45] Date of Patent: Dec. 23, 1986

[54] REFLECTOR ANTENNA HAVING SIDELOBE SUPPRESSION ELEMENTS

[75] Inventor: Daniel Jacavanco, Chelmsford, Mass.

[73] Assignee: The United States of America as represented by the Secretary of the Air Force, Washington, D.C.

[21] Appl. No.: 623,905

[22] Filed: Jun. 25, 1984

[51] Int. Cl.[4] ..... H01Q 19/19

[52] U.S. Cl. ..... 343/840; 343/915

[58] Field of Search ..... 343/840, 912, 914, 915, 343/916, 781 R, 781 P, 782, 880, 761, 379, 781 CA

[56] References Cited

U.S. PATENT DOCUMENTS

| | | | |
|---|---|---|---|
| 2,543,130 | 2/1951 | Robertson | 343/12 |
| 2,555,123 | 5/1951 | Gardner | 343/914 |
| 2,597,339 | 5/1952 | Krutter | 343/914 |
| 2,897,493 | 7/1959 | Thomas | 343/703 |
| 2,989,748 | 6/1961 | Doundoulakis et al. | 343/781 P |
| 3,019,430 | 1/1962 | Pedersen et al. | 343/12 |
| 3,101,473 | 8/1963 | Fenlon, Jr. | 343/760 |
| 3,196,442 | 7/1965 | Leffelman et al. | 343/765 |
| 3,412,405 | 11/1968 | Crotty et al. | 343/777 |
| 3,445,850 | 5/1969 | Stegen | 343/727 |
| 3,882,503 | 5/1975 | Gamara | 343/100 R |
| 4,065,748 | 12/1977 | Maguer et al. | 340/9 |
| 4,086,591 | 4/1978 | Siwiak et al. | 343/18 A |
| 4,274,098 | 6/1981 | Renau et al. | 343/781 CA |
| 4,376,940 | 3/1983 | Miedema | 343/840 |

FOREIGN PATENT DOCUMENTS

| | | | |
|---|---|---|---|
| 1297708 | 6/1969 | Fed. Rep. of Germany | 343/782 |
| 107604 | 7/1982 | Japan | 343/761 |

*Primary Examiner*—Eli Lieberman
*Assistant Examiner*—Michael C. Wimer
*Attorney, Agent, or Firm*—Richard J. Donahue; Donald J. Singer

[57] ABSTRACT

Suppression of selected sidelobes in a reflector antenna is accomplished by the positioning of two or more metallic disks on the reflector surface at specific distances above the reflector surface.

9 Claims, 6 Drawing Figures

REFLECTOR ANTENNA HAVING SIDELOBE SUPPRESSION ELEMENTS

STATEMENT OF GOVERNMENT INTEREST

The invention described herein may be manufactured and used by or for the Government for governmental purposes without the payment of any royalty thereon.

BACKGROUND OF THE INVENTION

The present invention relates to electromagnetic wave reception and transmission apparatus and more particularly, to a reflector type antenna having elements disposed on the reflective surface thereof for suppressing unwanted sidelobes in the original antenna pattern.

Various techniques have been used in the past for nulling or suppressing selected sidelobes in directional antenna systems. One such technique is adaptive nulling, particularly suitable for phased array systems, where a null is electronically placed in the antenna response pattern to reduce the amount of energy received from a jamming signal source. Adaptive nulling, however, requires costly components, complex algorithms, often requires long signal processing times, and is not suitable for reflector type antennas.

A known technique for reducing sidelobe interference in reflector type antennas involves the combining of the signal from the main antenna with that of an auxiliary antenna, suitably adjusted in amplitude and phase. Such auxiliary antenna systems, however, are generally expensive to fabricate and require high precision components and complex microwave circuitry to achieve adequate system performance.

In U.S. Patent No. 4,376,940 issued to H. Miedema on Mar. 15, 1983, there is disclosed an antenna arrangement for suppressing sidelobes, which consists of a pair of auxiliary antennas located at the edges of the reflector antenna such that, when the energy from the main and auxiliary antennas are combined in a hybrid coupler and associated circuitry, certain sidelobes are suppressed. An alternate embodiment of the invention involves laterally offsetting edge segments of the reflector to produce a radiation pattern which is phased opposite to the selected sidelobes to be suppressed.

A problem associated with sidelobe nulling by moving the edges of the reflector or by widely-spaced auxiliary antennas is the resultant formation of grating lobes which manifest themselves in the antenna pattern. Moreover, the amount of nulling that can be achieved is limited, since only the electromagnetic energy that meets the edge of the antenna is effected. In most instances, the energy reflected from the vicinity of the edge or rim of the reflector to the feed horn is purposely made much lower than the energy from the center region of the reflector to the feed horn. This is done in order to reduce overall sidelobes.

The use of such auxiliary antennas for nulling is generally restricted to the receiving mode due to the added requirements imposed on the signal processing equipment when high transmitted power levels are involved. It will also be apparent that the retrofitting of existing antennas to include auxiliary antennas or adjustable edge reflector elements could be prohibitively expensive.

SUMMARY OF THE INVENTION

It is therefore an object of this invention to provide apparatus for modifying the radiation pattern of a reflector type antenna.

It is a further object of the present invention to provide a reflector type antenna having means for placing nulls at select angular locations within its radiation pattern.

It is another object of the present invention to provide a directional antenna with identical sidelobe nulling characteristics in the transmission and reception modes.

It is yet another object of the present invention to provide a directional antenna with sidelobe suppression capability which does not degrade the response of the main beam of the antenna.

It is yet another object of the present invention to provide a directional antenna with sidelobe suppression capability which is inexpensive to fabricate.

These and other objects of the invention are obtained in a preferred embodiment thereof by positioning two small metal reflective disks on the curved inner wall of the main reflector facing the feed horn. The small disks are attached to rods which protrude through the reflector surface, permitting either manual or automatic adjustment of the disks from the back of the reflector. The disks are positioned at distances above the reflector surface which provide nulls at desired angular positions from the boresight axis of the antenna.

BRIEF DESCRIPTION OF THE DRAWINGS

The foregoing and additional objects, advantages and features of the present invention will be more fully understood from the following detailed description when read together with the accompanying drawings, in which.

DESCRIPTION OF THE PREFERRED EMBODIMENT

Figure 1A:
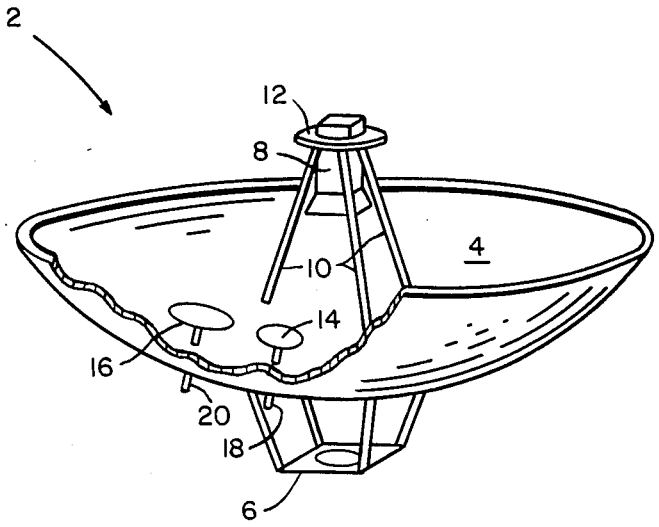
FIG. 1A is a pictorial representation of a reflector type antenna having the sidelobe suppressing or nulling disks of the present invention.

Referring now to FIG. 1A of the drawings, there is shown a reflector type antenna 2 having a parabolic reflector 4, attached to a mounting base or pedestal 6. A feed horn 8 is supported at the central axis or boresight of antenna 2 by tripod 10 and ring 12. Ring 12 permits a precision mechanical alignment of the feed horn 8 with the reflector 4. A part of reflector 4 has been broken away in the drawing to better show a pair of disks 14 and 16 that are supported by rods 18 and 20 respectively which protrude through the reflector 4.

Figure 1B:
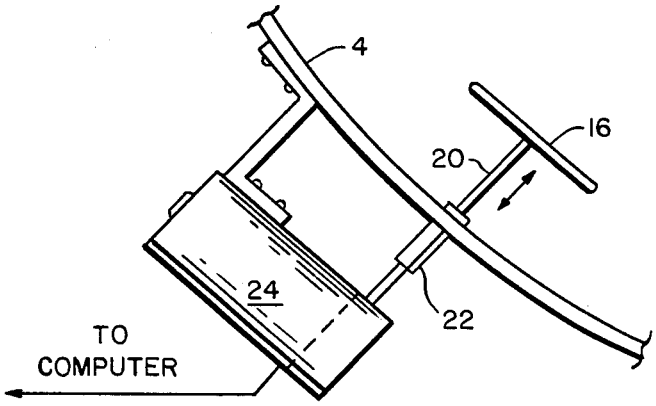
FIG. 1B is a side view of a portion of the reflector antenna of FIG. 1A which contains one of the sidelobe suppressing disks.

FIG. 1B depicts a side view of the portion of the reflector antenna in the vicinity of the disk 16. Rod 20 is held in place by collet chuck 22, which permits adjustment of the disk 16 at desired distances above the surface of reflector 4. It will be appreciated that in certain applications, it may be desirable to automatically adjust the height or penetration of disk 16 (and disk 14), and that this could be accomplished by coupling rod 20 (and rod 18) to a computer-controlled motor 24 positioned on the back surface of reflector 4.

Figure 2:
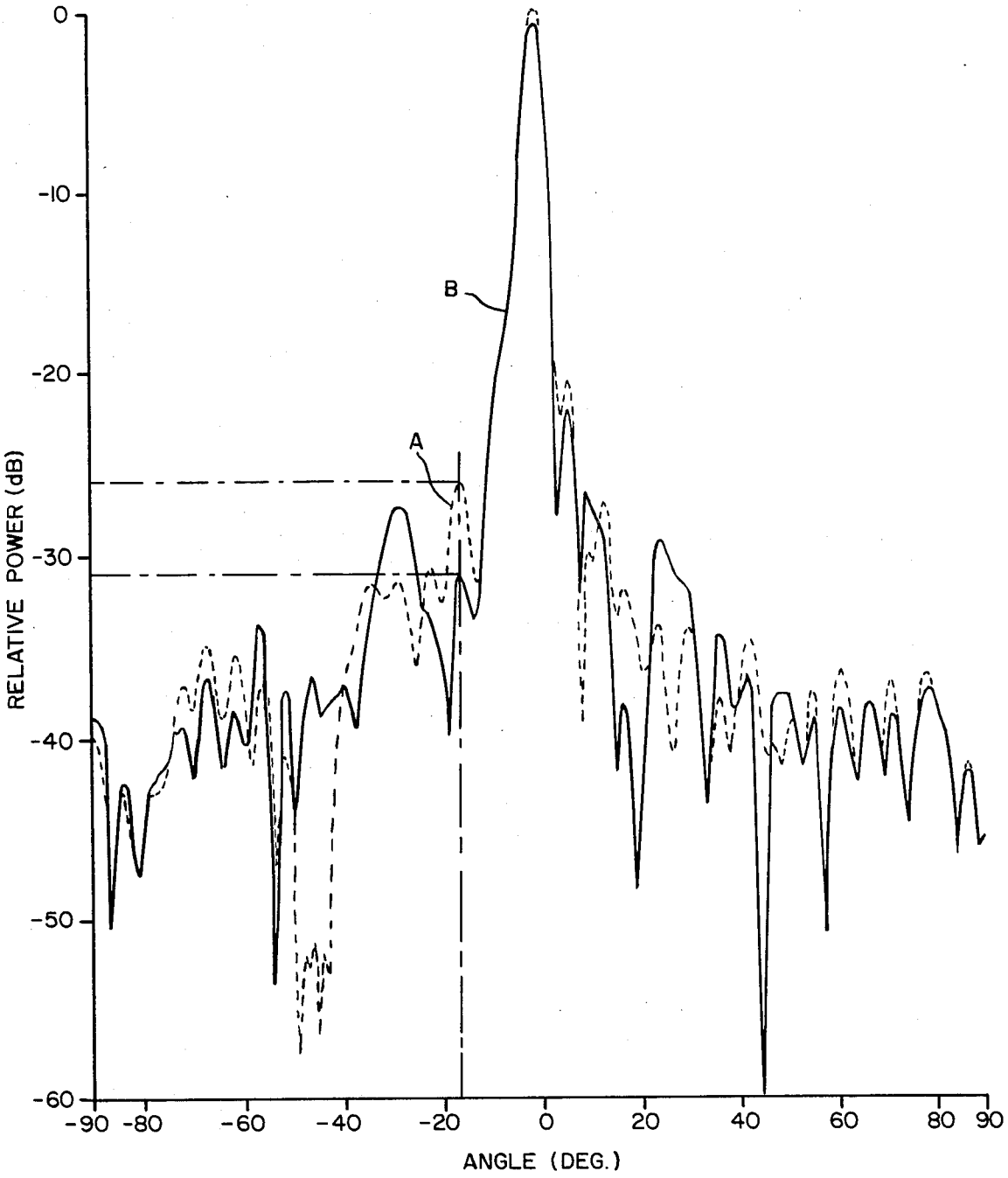
FIG. 2 is a graph depicting the measured H-plane power vs. angle patterns of a six foot reflector antenna before and after suppression of a sidelobe at −16 degrees.

A requirement for any nulling technique is that its implementation should not seriously degrade the normal performance of the antenna, especially in the main beam. FIG. 2 shows that the presence of the two disks 14 and 16, when moved away from the surface of reflector 4 to provide sidelobe suppression, has a minimal effect on the overall antenna pattern. In FIG. 2, the dotted response pattern A was plotted with the disks 14 and 16 positioned against the reflector 4. Disk 14 had a diameter of five inches and had its center located 2.5 inches from the center of reflector 4. Disk 16 had a diameter of eight inches and its center was 12.5 inches from the center of reflector 4. Both disks were made of aluminum having a thickness of 0.125 inches. The antenna 2 was a commercially procured S-band paraboloid antenna with a focal length of twenty seven inches and the disks 14 and 16 were located on the reflector 4 within the area defined by one half of the radius of the aperture of the antenna.

The 5 dB sidelobe cancellation seen at −16 degrees in the solid response pattern curve B was achieved by adjusting the positions of disks 14 and 16 while the antenna was positioned at 16 degrees from the energy source. Disks 14 and 16 were alternately adjusted for minimum received energy. The final additional penetration distances of disks 14 and 16 were 0.110 inches and 0.050 inches respectively. The frequency of operation was in S-band, signifying that disk 14 was changed in phase by approximately twenty electrical degrees and disk 16 by approximately nine electrical degrees. Disks 14 and 16 were then locked in place and the response pattern curve B was generated.

Figure 3:
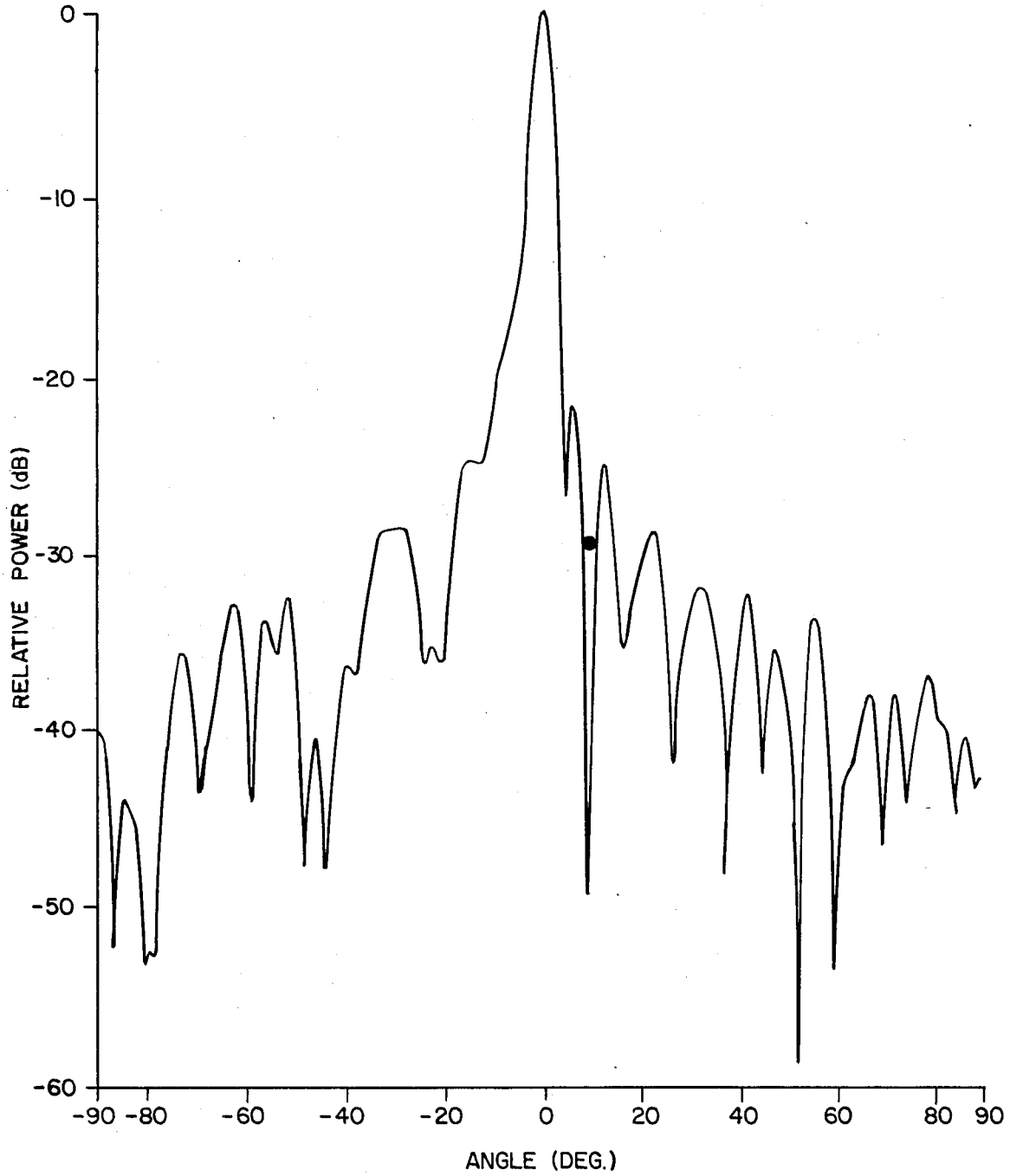
FIG. 3 is a graph of the measured H-plane power vs. angle pattern of a six foot reflector antenna having a null placed at nine degrees by the present invention.

FIG. 3 is an H-plane pattern of the same reflector antenna after nulling was accomplished at nine degrees. The large dot indicates the original level of the antenna sidelobe response before nulling. Disk 14 had a penetration distance of 0.825 inches and disk 16 had a penetration distance of 1.545 inches to provide 20 dB of cancellation.

Figure 4:
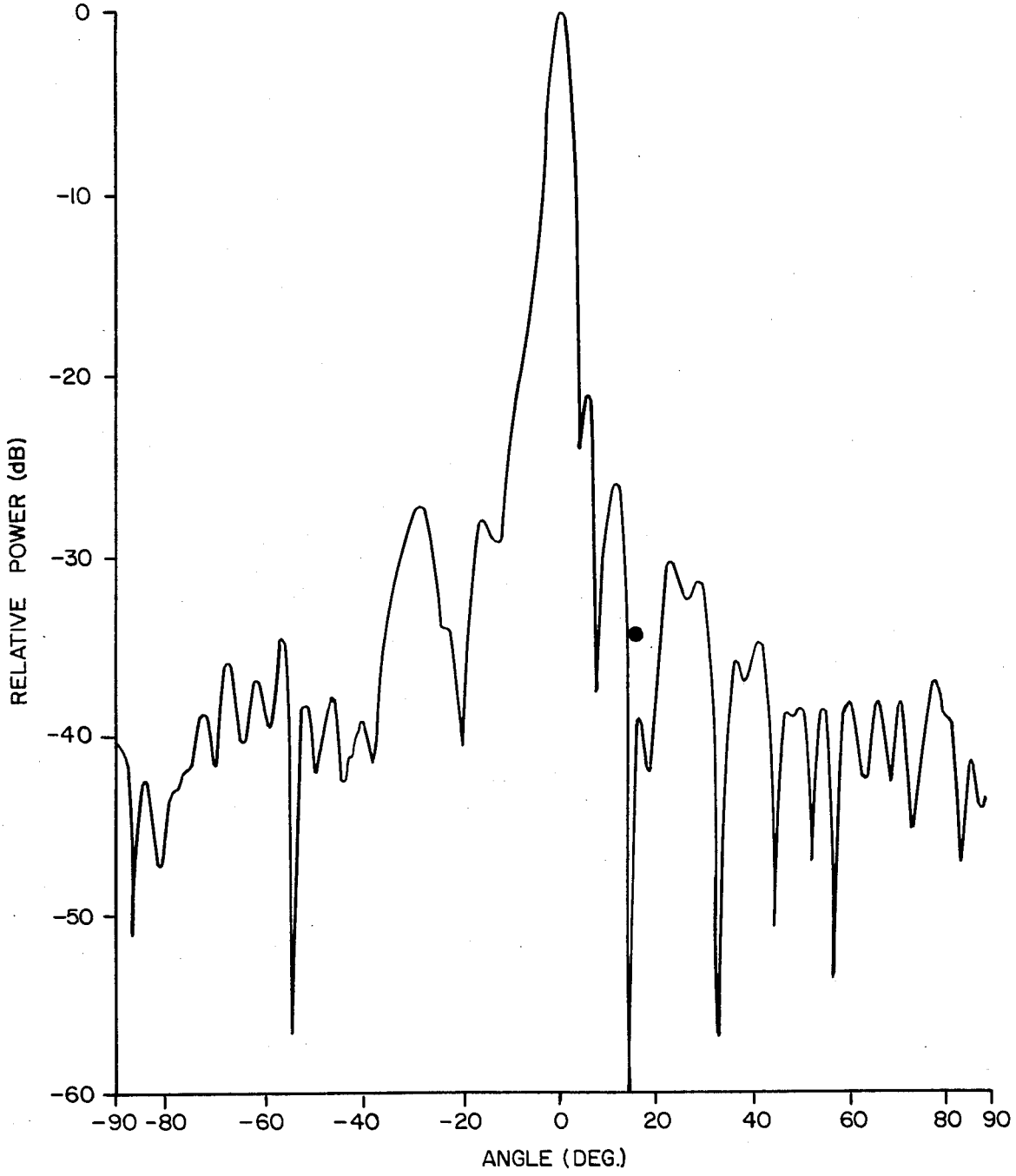
FIG. 4 is a graph of the measured H-plane power vs. angle pattern of a six foot reflector antenna having a null placed at fifteen degrees by the present invention.

FIG. 4 represents further measurements of the present invention. Here, a null of approximately 30 dB was achieved at 15 degrees with a disk 14 penetration distance of 2.625 inches and a disk 16 penetration distance of 2.375 inches.

Figure 5:
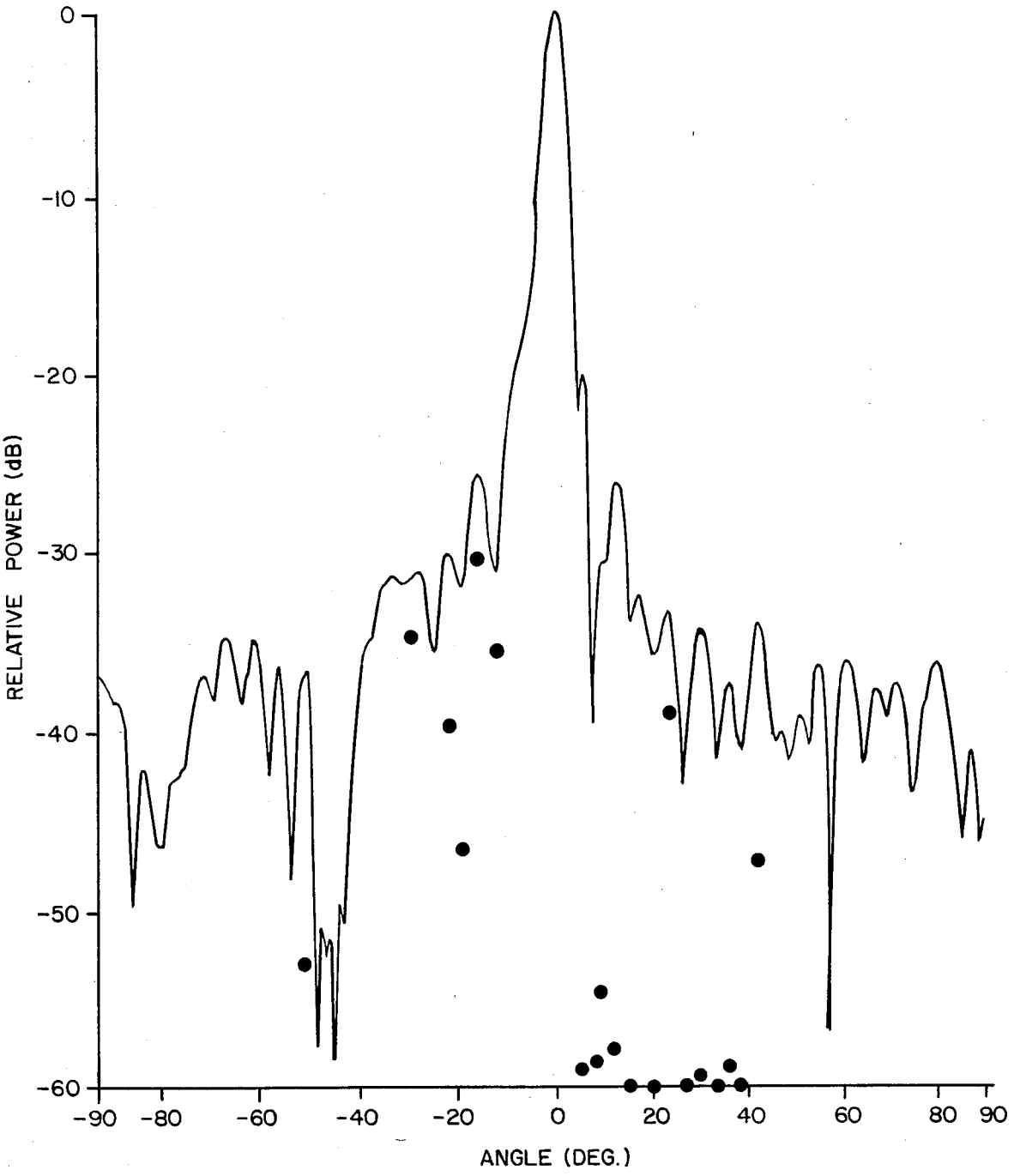
FIG. 5 is a graph of the normal measured H-plane power vs. angle pattern of a six foot reflector antenna and various points denoting the amount of sidelobe suppression achieved with one embodiment of the present invention over its normal response pattern.

FIG. 5 differs from the preceding graphs in that the graph depicts the original pattern of the antenna when the disks are at their rest position, while the dots indicate the amount and angular position of sidelobe suppression provided by the disks at different penetration distances.

It has been found that (n−1) nulls can be provided within the antenna pattern by the use of (n) disks, where n is an integer less than the number of half wavelengths in the antenna aperture. The size of the disks and their position on the reflector surface should be selected with the following considerations. If nulling is desired in a uniformly illuminated reflector in the region of the pattern where the antenna sidelobe response is down 30 dB from the mainbeam peak, then the total area of the two disks relative to the total area of the reflector should also be down by 30 dB. In an antenna in which the feed horn imposes a tapered illumination across the dish for sidelobe control, the size and position of the disks should be further modified. For the same performance, a larger disk is required if positioned in the region of lower intensity than a disk positioned in a region of higher intensity (near the center). In order to prevent the generation of grating lobes in the response pattern, the separation between the disks should be as small as practicable.

In certain applications, it may be desirable that the disks be replaced with reflective elements having other geometric shapes and/or with elements having polarization dependent surface reflection properties.

Although the invention, as herein disclosed, has been described with reference to certain specific embodiments, other structures than those herein disclosed which embody the principles of this invention will be obvious to those skilled in the art and are intended to be embraced on the appended claims.

What is claimed is:

1. In a directional antenna of the type having a substantially parabolic main reflector of electromagnetic energy and a feed horn positioned at the focal point of said main reflector characterized in that said antenna further comprises:

a plurality of energy reflecting elements affixed to the focusing surface of said main reflector and being entirely within the aperture of said main reflector;

each of said plurality of energy reflecting elements having its reflecting surface parallel to the tangent of said main reflector at the point where affixed to said main reflector; and means for individually adjusting the penetration distance of said reflecting elements above the surface of said main reflector to suppress selected sidelobes in the response pattern of said antenna.

2. Apparatus as defined in claim 1 wherein said energy reflecting elements are assymmetrically disposed on the focusing surface of said main reflector.

3. Apparatus as defined in claim 2 wherein said plurality of energy reflecting elements comprise a pair of metallic disks positioned on said antenna.

4. Apparatus as defined in claim 3 wherein said pair of metallic disks are positioned at different radii from the boresight axis of said antenna.

5. Apparatus as defined in claim 5 wherein said pair of metallic disks have different diameters and wherein the one of said pair of disks closest to said boresight axis has the smaller diameter.

6. Apparats as defined in claim 5 wherein said pair of disks are located within the area on said focusing surface of said main reflector defined by one half of the radius of the aperture of said antenna.

7. Apparatus as defined in claim 6 wherein the decibel ratio of the combined areas of said pair of disks to the area of said main reflector is substantially equal to the decibel ratio of the peak value of the sidelobe to be suppressed to the peak value of the main beam of said antenna.

8. Apparatus as defined in claim 7 wherein said disks are affixed to said main reflector by adjusting rods attached to said disks and passing through holes formed through said main reflector.

9. Apparatus as defined in claim 8 and further comprising a stepping motor coupled to each of said adjusting rods at the back of said main reflector for adjusting said penetration distance of said pair of disks.

* * * * *